US007887172B2

(12) United States Patent
Uchino

(10) Patent No.: US 7,887,172 B2
(45) Date of Patent: Feb. 15, 2011

(54) LIQUID CONTAINER

(75) Inventor: Yuta Uchino, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 550 days.

(21) Appl. No.: 11/966,519

(22) Filed: Dec. 28, 2007

(65) Prior Publication Data

US 2008/0158316 A1 Jul. 3, 2008

(30) Foreign Application Priority Data

Dec. 28, 2006 (JP) ..... 2006-353986

(51) Int. Cl.
*B41J 2/175* (2006.01)

(52) U.S. Cl. ..... 347/86; 347/85; 347/5

(58) Field of Classification Search ..... 347/7, 347/85, 86, 87, 5, 9, 14
See application file for complete search history.

(56) References Cited

U.S. PATENT DOCUMENTS

| | | | |
|---|---|---|---|
| 5,701,995 | A | 12/1997 | Hiuma et al. |
| 6,164,769 | A | 12/2000 | Inada et al. |
| 6,241,348 | B1 | 6/2001 | Haigo |
| 6,276,786 | B1 | 8/2001 | Eida et al. |
| 2005/0099471 | A1 | 5/2005 | Mukai et al. |
| 2006/0103702 | A1 | 5/2006 | Takagi |
| 2006/0203051 | A1 | 9/2006 | Kanbe |

FOREIGN PATENT DOCUMENTS

| | | | |
|---|---|---|---|
| JP | H05-162326 | A | 6/1993 |
| JP | H06-328712 | A | 11/1994 |
| JP | H07-076267 | A | 3/1995 |
| JP | H08-025640 | A | 1/1996 |
| JP | H09-187962 | A | 7/1997 |
| JP | H09-90516 | A | 11/1997 |
| JP | H11-058775 | A | 3/1999 |
| JP | 2000255082 | A | 9/2000 |
| JP | 2000255625 | A | 9/2000 |
| JP | 2003154675 | A | 5/2003 |
| JP | 2003320685 | A | 11/2003 |
| JP | 2005153506 | A | 6/2005 |
| JP | 2006021476 | A | 1/2006 |
| JP | 2006110798 | A | 4/2006 |
| JP | 2006142590 | A | 6/2006 |
| JP | 2006159512 | A | 6/2006 |
| JP | 2006192848 | A | 7/2006 |
| JP | 2006212883 | A | 8/2006 |
| JP | 2006-248053 | A | 9/2006 |

*Primary Examiner*—Lam S Nguyen
(74) *Attorney, Agent, or Firm*—Baker Botts L.L.P.

(57) ABSTRACT

A liquid container includes a case having a liquid reservoir portion defined therein, and a covering member attached to the case to cover an atmospheric introduction opening formed at the case. When the covering member moves relative to the case, the atmospheric introduction portion is opened, and thereby the liquid reservoir portion is brought into fluid communication with the atmosphere.

16 Claims, 9 Drawing Sheets

LIQUID CONTAINER

CROSS-REFERENCE TO RELATED APPLICATIONS

This application is based upon and claims the benefit of priority from Japanese Patent Application No. 2006-353986, filed on Dec. 28, 2006, the entire contents of which are incorporated herein by reference.

TECHNICAL FIELD

The present invention generally relates to a liquid container configured to store liquid, such as an ink cartridge, removably mounted to an apparatus, such as a printer, a facsimile machine, an image recording apparatus, and a multi-function apparatus, for image recording using liquid such as ink. In particular, the present invention relates to a liquid container provided with an openable atmospheric release valve.

BACKGROUND

A known ink cartridge includes a case including an ink reservoir portion (ink chamber) therein. An ink supply opening and an atmospheric introduction opening are formed through the same side wall of the case. The ink cartridge also includes an ink supply valve configured to selectively open and close the ink supply opening and an atmospheric release valve configured to selectively open and close the atmospheric introduction opening. When the ink supply valve opens the ink supply opening, ink is supplied from the reservoir portion to the outside of case via the ink supply opening. When atmospheric release valve opens the atmospheric introduction opening, the ink reservoir portion is bought into fluid communication with the atmosphere via the atmospheric introduction opening.

Before the ink cartridge is mounted in an image forming apparatus, the pressure in the ink reservoir portion storing ink is less than the atmospheric pressure, and the atmospheric release valve and the ink supply valve are urged by a compression spring, respectively, to close the ink supply opening and the atmospheric introduction opening, respectively, thereby sealing the ink cartridge.

In this ink cartridge, a rod-shaped operation portion for operating the atmospheric release valve protrudes from the inside of the case to the outside of the case through the atmospheric introduction opening.

If the operation portion is erroneously operated such that the atmospheric release valve opens the atmospheric introduction opening when the ink cartridge is transported or is kept in storage, air enters the ink reservoir portion, and the air dissolves into ink. Moreover, if the atmospheric introduction opening is located below the ink reservoir portion while the atmospheric introduction opening is opened by the atmospheric release valve, ink leaks from the ink reservoir portion to the outside of the case through the atmospheric introduction opening.

Therefore, a protection member is attached to the side wall of the case through which the ink supply opening and the atmospheric introduction opening are formed. The protection member has a hole formed therethrough or a recess formed therein to receive the operation portion. The ink cartridge with the protection member attached thereto is then packed in a resin bag, and the interior of the bag is depressurized. Such a known ink cartridge is described in JP-A-2006-142590 for example.

Nevertheless, if air is dissolved in ink stored in the ink reservoir portion when the ink cartridge is mounted to an image recording apparatus and ink is supplied from the ink cartridge to a recording head, the air turns into bubbles in the recording head, which causes clogging of nozzles formed in the recording head, leading to printing failure. In order to prevent this printing failure, deaerated ink is stored in the ink reservoir portion. Moreover, in order to maintain the deaeration of the ink, the pressure in the ink reservoir portion is lowered to be less than the atmospheric pressure.

When the ink cartridge is mounted to the image recording apparatus, if the ink supply valve is operated to open the ink supply opening before the atmospheric release valve is operated to open the atmospheric introduction opening, ink in the nozzles of the recording head is drawn towards the ink cartridge because the pressure in the ink reservoir portion is less than the atmospheric pressure. This breaks the menisci of ink in the nozzles. Therefore, air enters into ink passages formed in the recording head through the nozzles and remains in the ink passages, which leads to printing failure. As a result, maintenance work to restore printing quality is additionally required, which may discard much ink.

Therefore, a user may be instructed to operate the atmospheric release valve to open the atmospheric introduction opening to bring the ink reservoir portion into fluid communication with the atmosphere prior to mounting the ink cartridge to the image recording apparatus. Nevertheless, if the atmospheric introduction opening is located below the ink supply opening when the user holds the ink cartridge in his hand, air introduced via the atmospheric introduction opening may reach the vicinity of the ink supply opening. If the ink cartridge is then mounted to the mounting portion, air bubbles are supplied to the recording head via the ink supply opening, which leads to printing failure.

SUMMARY

Therefore, a need has arisen for a liquid container which overcomes these and other shortcomings of the related art. A technical advantage of the present invention is that an atmospheric release valve is readily operated to open an atmospheric introduction opening before a liquid supply valve is operated to open a liquid supply opening. Another technical advantage of the invention is that the configuration of the liquid container may allow a user to operate the atmospheric release valve only when the liquid container is positioned in a predetermined orientation.

According to an aspect of the invention, there is provided a liquid container comprising: a case having a liquid reservoir portion defined therein, and having a particular face at which an atmospheric introduction opening is positioned; an atmospheric release valve positioned in the case and configured to selectively open the atmospheric introduction opening to allow the liquid reservoir portion to communicate with the atmosphere via the atmospheric introduction opening and close the atmospheric introduction opening to prevent the liquid reservoir portion from communicating with the atmosphere via the atmospheric introduction opening, wherein the atmospheric release valve comprises an operation portion extending from an inside of the case to an outside of the case via the atmospheric introduction opening in a first direction; and a covering member attached to the case to cover the atmospheric introduction opening and configured to move relative to the case in a second direction and a third direction opposite the second direction, wherein each of the second direction and the third direction is substantially perpendicular to the first direction, and the covering member comprises a cam protrusion, wherein, when the covering member moves in the second direction, the cam protrusion applies a force to the operation portion to move the operation portion in a fourth direction opposite the first direction such that the atmospheric release valve opens the atmospheric introduction opening.

According to another aspect of the invention, there is provided a liquid container comprising: a case having a liquid reservoir portion defined therein; an atmospheric release valve configured to move between an open position and a close position, the liquid reservoir portion being allowed to communicate with the atmosphere when the atmospheric release valve is positioned at the open position, and the liquid reservoir portion being prevented from communicating with the atmosphere when the atmospheric release valve is positioned at the close position, wherein the atmospheric release valve comprises an operation portion configured to move between an operation position and an non-operation position, the atmospheric release valve is positioned at the open position when the operation portion is positioned at the operation position and the atmospheric release valve is positioned at the close position when the operation portion is positioned at the non-operation position; and a covering member movable from a first position to a third position via a second position and comprising a cam protrusion, wherein, when the covering member is positioned at the first position, the covering member covers the operation portion and allows the operation portion to be positioned at the non-operation position, wherein, when the covering member is positioned at the second position, the cam protrusion contacts the operation portion to position the operation portion at the operation position, and wherein, when the covering member is positioned at the third position, the covering member allows the operation portion to be positioned at the non-operation position.

Other objects, features, and advantages of embodiments of the present invention will be apparent to persons of ordinary skill in the art from the following description of preferred embodiments with reference to the accompanying drawings.

DESCRIPTION OF EMBODIMENTS

Embodiments of the present invention and their features and technical advantages may be understood by referring to FIGS. 1A-9.

Figure 1B:
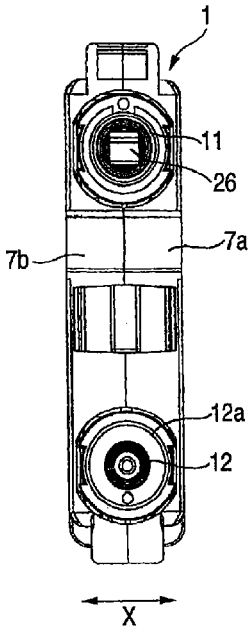
FIG. 1B is a front view of the ink cartridge of FIG. 1A.
Figure 1A:
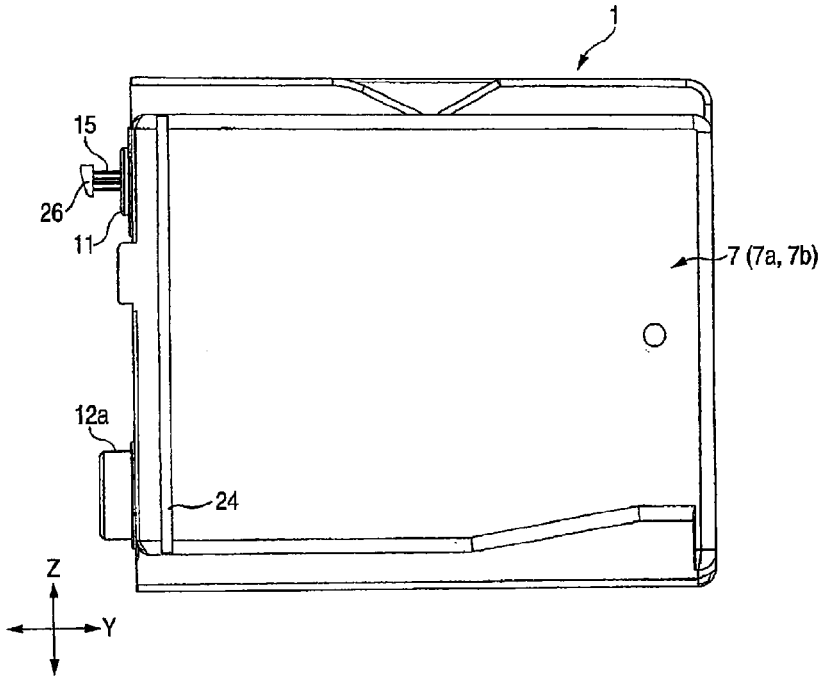
FIG. 1A is a side view of an ink cartridge according to an embodiment of the present invention in which a covering member has been removed.
Figure 2B:
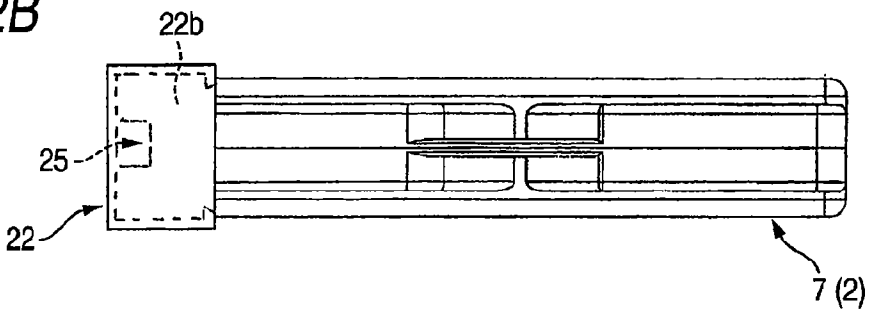
FIG. 2B is a plan view of the ink cartridge of FIG. 2A.
Figure 2A:
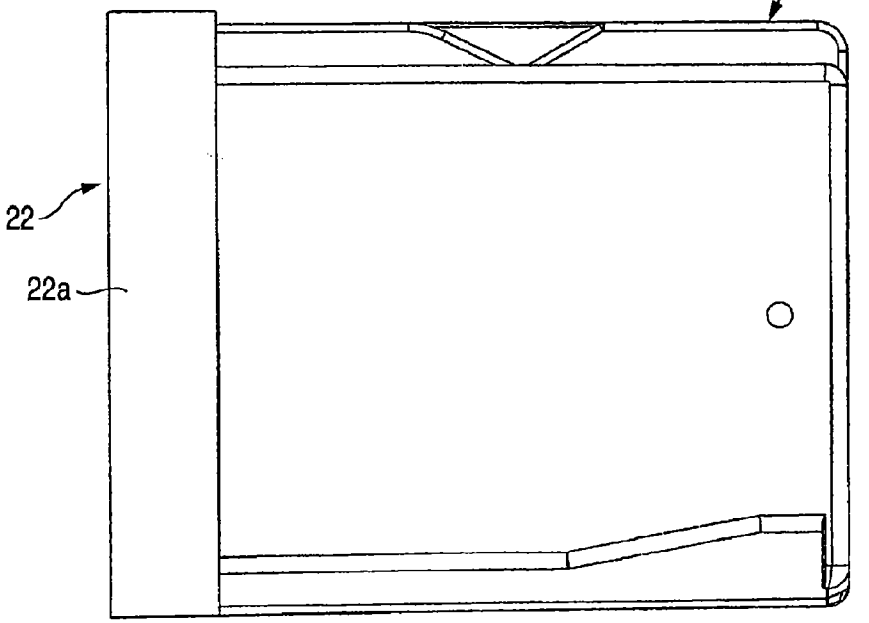
FIG. 2A is a side view of the ink cartridge of FIGS. 1A and 1B in which the covering member is illustrated.
Figure 2C:
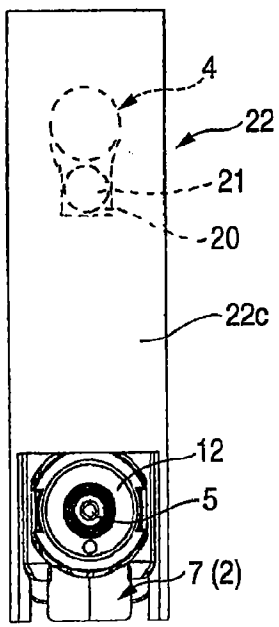
FIG. 2C is a front view of the ink cartridge of FIG. 2A.
Figure 5:
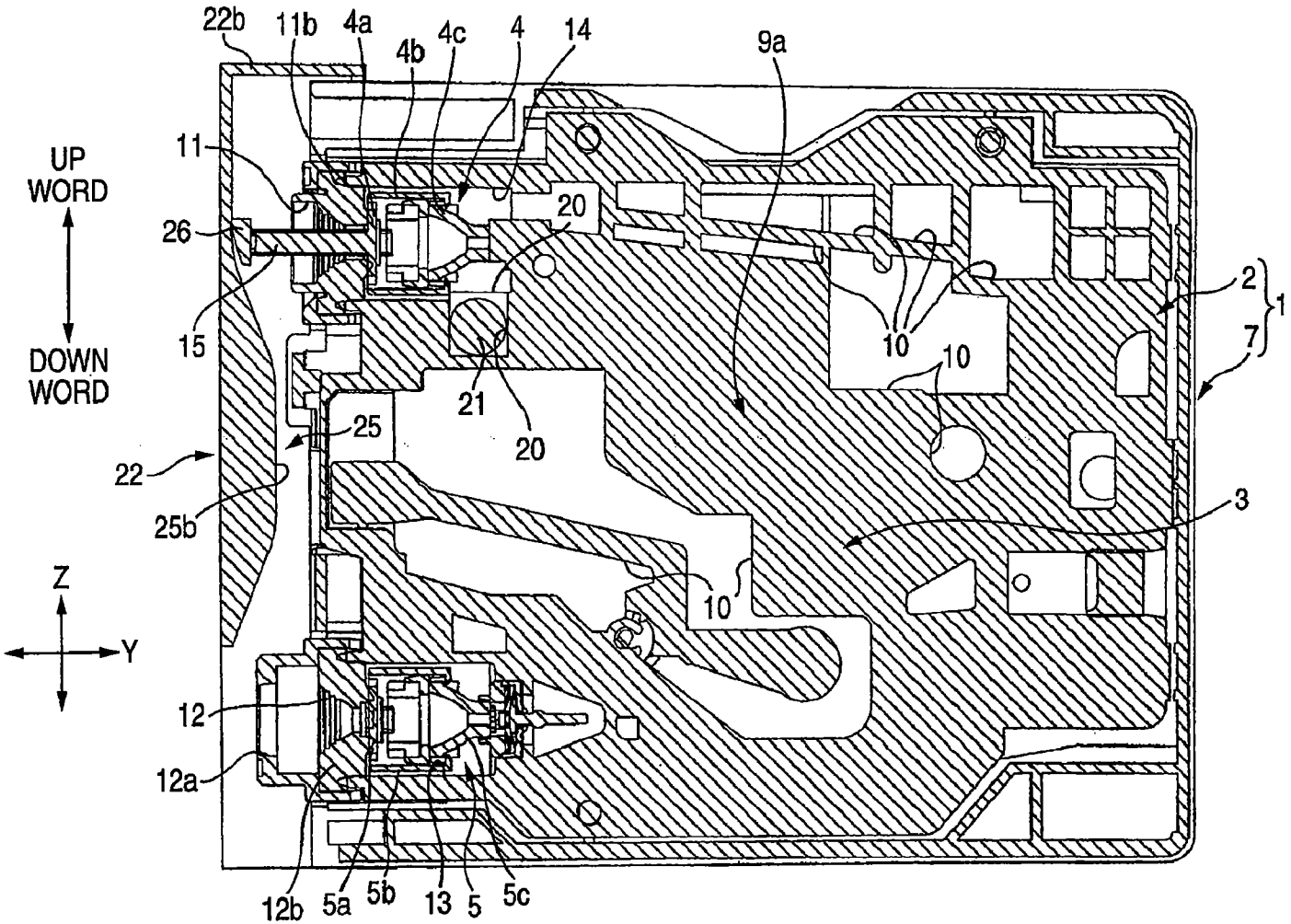
FIG. 5 is a cross-sectional view of the ink cartridge of FIGS. 2A-2C in which the atmospheric introduction opening and the ink supply opening are aligned in a direction parallel to the gravitational direction.
Figure 6A:
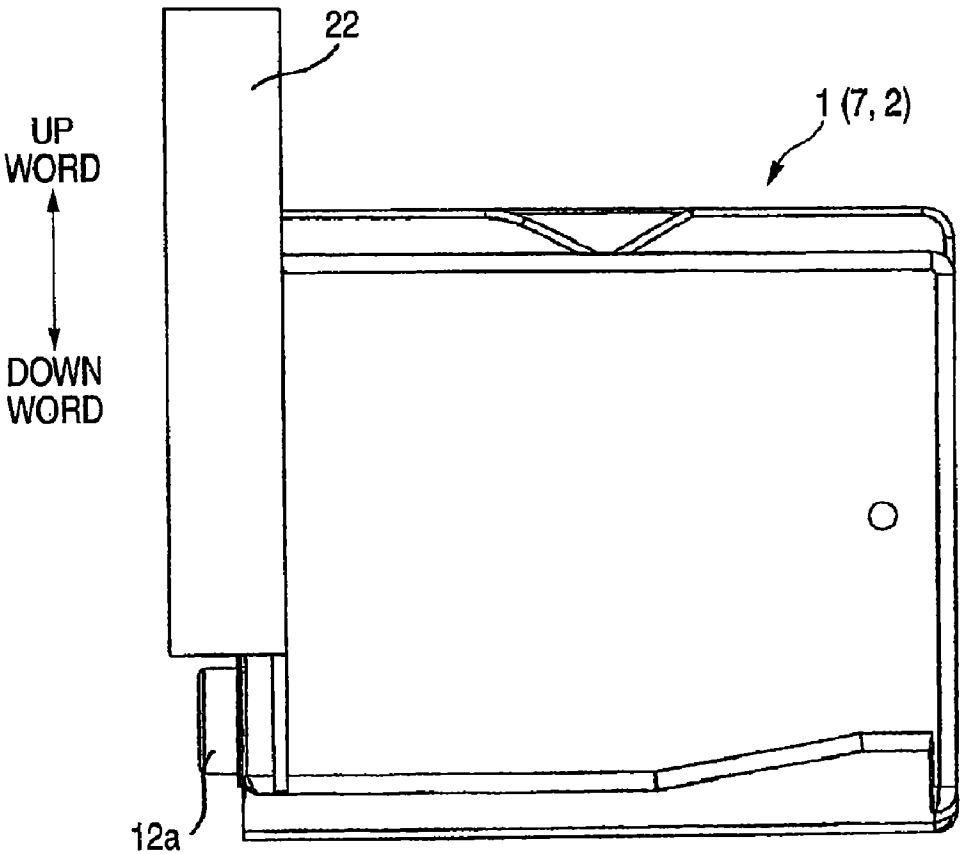
FIG. 6A is a side view of the ink cartridge of FIGS. 2A-2C when the ink cartridge is positioned in a correct orientation and the covering member is removed from a case of the ink cartridge.
Figure 6B:
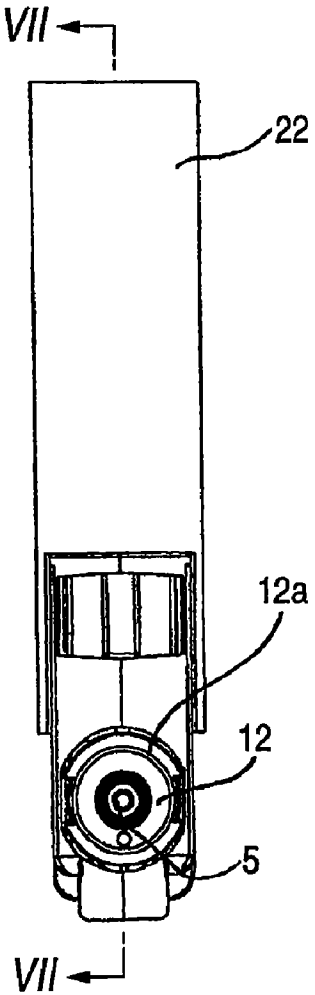
FIG. 6B is a front view of the ink cartridge of FIG. 6A.

As shown in FIG. 1A, FIG. 1B and FIG. 5, an ink cartridge 1, according to an embodiment of the present invention, includes a inner case 2 and an outer case 7 that encloses the inner case 2. The inner case 7 includes an ink reservoir portion 3 formed therein to store ink. The ink cartridge 1 also includes an atmospheric release valve 4 and an ink supply valve 5 positioned in the inner case 7. Each of the inner case 2 and the outer case 7 has a substantially rectangular parallelepiped shape having a front face, a rear face opposite the front face, a top face, a bottom face opposite the top face, a right side face, and a left side face opposite the right side face. Each of the top face and the bottom face is connected to the front face and the rear face, and each of the right side face and the left side face is connected to the front face, the rear face, the top face, and the bottom face. Each of the front face, the rear face, the top face, the bottom face, the right side face, and the left side face is substantially parallel to the opposing face and substantially perpendicular to the other faces. Each of an area of the right side face and an area of the left side face is greater than each of an area of the front face, an area of the rear face, an area of the top face, and an area of the bottom face. Each of the inner case 2 and the outer case 7 has a width between the right side face and the left side face in an X-axis direction, a depth between the front face and the rear face in a Y-axis direction, and a height between the top face and the bottom face in a Z-axis direction. The X-axis direction, the Y-axis direction, and the Z-axis direction are perpendicular to each other. The outer case 7 includes a left cover member 7*a* covering the left side face of the inner case 2 and a right cover member 7*b* covering the right side face of the inner case 2, and the left cover member 7*a* and the right cover member 7*b* are connected to each other to enclose the inner case 2.

As shown in FIG. 5, the inner case 2 includes a frame having a substantially rectangular perimeter extending along the front face, the top face, the rear race and the bottom face. The frame opens on the right side face, and the left side face. Films are adhered to the left side face and the right side face of the frame, respectively, to cover the openings of the frame, respectively. The frame and the films define the ink reservoir portion 3 therein. The frame includes a flat plate 9*a* positioned at an intermediate portion in the X-axis direction. The flat plate 9*a* divides at least a portion of the ink reservoir portion 3 into a left side sub-portion and a right side sub-portion. The flat plate 9*a* has a plurality of openings 10, and the left side sub-portion is in fluid communication with the right side sub-portion via the plurality of openings 10.

An atmospheric introduction opening 11 and an ink supply opening 12 are formed through the front face of the inner case 2. Each of the atmospheric introduction opening 11 and the ink supply opening 12 has substantially a conical shape. The atmospheric introduction opening 11 and the ink supply opening 12 are positioned at the front face of the outer case 7 and exposed to the outside of the outer case 7 through openings formed through the front face of the outer case 7. A cylindrical cap 12*a* protrudes from the front face of the inner case 2 to surround the ink supply opening 12.

The inner case 2 includes an ink supply chamber 13 formed therein, and the ink supply chamber 13 is connected to the ink supply opening 12. The ink supply chamber 13 is configured to be in fluid communication with the ink reservoir portion 3. The ink cartridge 1 also includes a valve seat 12*b*, and a portion of the valve seat 12*b* is fitted in the ink supply chamber 13. The ink supply opening 12 is formed through the valve seat 12*b* in the Y-axis direction. The ink supply valve 5 is positioned in the ink supply chamber 13 and includes a valve body 5*a*, a valve supporting frame 5*b*, and a substantially conical spring 5*c* positioned in this order in the Y-axis direction from the ink supply opening 12 towards the ink reservoir portion 3. The ink supply valve 5 is configured to be movable in the Y-axis direction. The spring 5*c* is formed of a resilient material such as rubber. The valve supporting frame 5*b* supports the valve body 5*a*, and a portion of the spring 5*c* is positioned within the valve supporting frame 5*b*. The valve body 5*a* is urged by the spring 5*c* to contact the valve seat 12*b* and close the ink supply opening 12. If the ink cartridge 1 is mounted to a cartridge mounting portion (not illustrated) of an image recording apparatus (not illustrated), the valve body 5*a* is pushed by an ink extraction pipe protruding from the cartridge mounting portion. The valve body 5*a* then moves to separate from the valve seat 12*b* against the urging force of the spring 5*c*. As a result, the ink supply opening 12 is opened, and ink in the ink reservoir portion 3 is supplied to a recording head (not illustrated) of the image recording apparatus via the ink extraction pipe.

The inner case 2 includes an atmospheric introduction chamber 14 formed therein, and the atmospheric introduction chamber 14 is connected to the atmospheric introduction opening 11. The atmospheric introduction chamber 14 is configured to be in fluid communication with the ink reservoir portion 3. The ink cartridge 1 also includes a valve seat 11*b*, and a portion of the valve seat 11*b* is fitted in the atmospheric introduction chamber 14. The atmospheric introduction opening 11 is formed through the valve seat 11*b* in the Y-axis direction. The atmospheric release valve 4 is positioned in the atmospheric introduction chamber 14 and includes a valve body 4*a*, a valve supporting frame 4*b*, and a substantially conical spring 4*c* positioned in this order in the Y-axis direction from the atmospheric introduction opening 11 towards the ink reservoir portion 3. The atmospheric release valve 4 is configured to be movable in the Y-axis direction. The spring 4*c* is formed of a resilient material such as rubber. The valve body 4*a* is urged by the spring 4*c* to contact the valve seat 11*b* and close the air introduction opening 11. An operation rod 15 extends from the valve body 4*a* to the outside of the inner case 2 and to the outside of the outer case 7 via the atmospheric introduction opening 11 in a first direction, which is parallel to the Y-axis direction. A space 20 that communicates with the interior of the atmospheric introduction chamber 14 is formed adjacent to the atmospheric introduction chamber 14. A spherical body such as steel ball 21 is movably positioned in the space 20. The spherical body 21 is movable along the guiding surface 20*a* defining a portion of the space 20. The guiding surface 20*a* extends in the Z-axis direction. In other words, the guiding surface 20*a* guides the spherical body 21 in a direction along which the spherical body 21 moves to and moves away from the spring 4*c* of the atmospheric release valve 4. In further other words, the guiding surface 20*a* guides the spherical body 21 in a direction connecting a first position in which the spherical body 21 is positioned adjacent to the spring 4*c* and the atmospheric release valve 4 is prevented from moving and a second position in which the spherical body 21 is positioned away from the spring 4*c* and the atmospheric release valve 4 is allowed to move.

The spherical body 21 moves to and moves away from the atmospheric release valve 4 by the gravitational force acting on the spherical body 21 or by a component of the gravitational force acting on the spherical body 21 along the guiding surface 20*a* of the space 20.

Figure 3B:
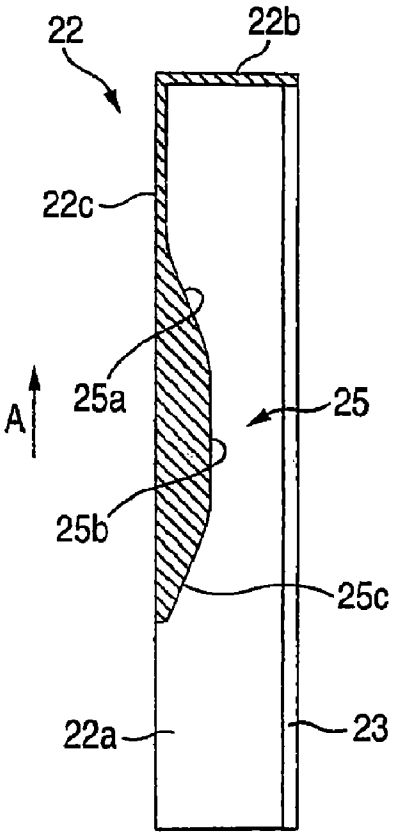
FIG. 3B is a cross-sectional view taken along the line IIIb-IIIb of FIG. 3A.
Figure 3A:
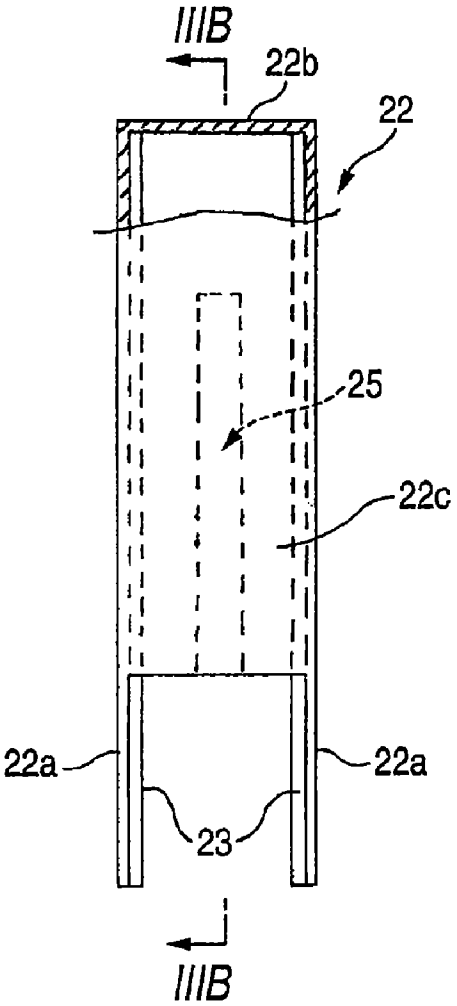
FIG. 3A is a partially-cross-sectional front view of the covering member of FIGS. 2A-2C.

If the operation rod 15 is pushed against the urging force of the spring 4*c*, the valve body 4*a* moves and separates from the valve seat 11*b* and the atmospheric introduction opening 11 is opened. In this embodiment, as shown in FIG. 3A and FIG. 3B, the ink cartridge 1 further includes a covering member 22 including a pair of left and right side walls 22*a*, a top wall 22*b* connected to top ends of the pair of side walls 22*a*, and a front wall 22*c* connected to the front ends of the pair of side walls 22*a* and the top wall 22*b*. The pair of left and right side walls 22*a* is configured to cover at least a portion of the left side face and the right side face of the outer case 7 respectively, the top wall 22*b* is configured to cover at leas a portion of the top face of the outer case 7, and the front wall 22*c* is configured to cover at least a portion of the front face of the outer case 7. The covering member 22 is configured to be removably attached to the outer case 7 such that the covering member 22 covers the atmospheric introduction opening 11. The covering member 22 is configured to be removed from the outer case 7 in a second direction and to be attached to the outer case 7 in a third direction opposite the second direction. The second direction and the third direction are parallel to the Z-axis direction. In other words, each of the second direction and the third direction is perpendicular to the first direction in which the operation rod 15 extends from the valve body 4*a* to the outside of the outer case 7. Incidentally, the atmospheric introduction opening 11 and the ink supply opening 12 are aligned in a direction parallel to the second direction and the third direction. In further other words, the covering member 22 is configured to be attached to and removed from the outer case 7 in directions substantially parallel to a direction in which the front face of the inner case 2 and the front face of the outer case 7 extend.

A cam protrusion 25 extending in the Z-axis direction is positioned at an inner surface of the front wall 22*c* facing the front face of the outer case 7 and the front face of the inner case 2. When the covering member 22 is removed from the outer case 7 in the second direction, which is parallel to the front face of the inner case 2 and the front face of the outer case 7, the cam protrusion 25 applies a force to the operation rod 15, e.g., contacts and pushes the operation rod 15, to move the operation rod 15 in a fourth direction opposite the first direction in which the operation rod 15 extends from the valve body 4*a*. The valve body 4*a* then moves to separate from the valve seat 11*b* against the urging force of the spring 4*c*. As a result, the atmospheric introduction opening 11 is opened, and the ink reservoir portion 3 is brought into fluid communication with the atmosphere.

In this embodiment, a guide protrusion ridge 23 extending in a direction parallel to the second and third directions is formed on an inner surface of each of a pair of left and right side walls 22*a*. A guide groove 24 extending in the direction parallel to the second and third directions is formed in each of the left side face and the right side face of the outer case 7. The guide protrusion ridges 23 are configured to slidably engage the guide grooves 24. The top wall 22*b* functions as a stopper, that is, the top wall 22*b* is configured to restrict the movement of the covering member 22 relative to the outer case 7 in the third direction, e.g., configured to contact the top face of the outer case 7 and to prevent further movement of the covering member 22 relative to the outer case 7 in the third direction.

The covering member 22 can be removed from the outer case 7 only in the second direction because the top wall 22*b* is configured to contact the top face of the outer case 7 and to prevent further movement of the covering member 22 relative to the outer case 7 in the third direction. The atmospheric introduction opening 11 is positioned apart from the ink supply opening 12 such that the atmospheric introduction opening 11 is positioned on a downstream side and the ink supply opening 12 is positioned on an upstream side in the second direction (the direction of the arrow An in FIG. 3B). Therefore, most part of the front wall 22*c* of the covering member 22 can be used for covering the atmospheric introduction opening 11 during the movement of the covering member 22 in the second direction. In the other words, the covering member 22 is configured to cover the atmospheric introduction opening 11 until the very end of removing the covering member from the outer case 7.

In this embodiment, as shown in FIG. 3A and FIG. 3B, the cam protrusion 25 extends relatively long in the second direction. Moreover, a profile of the cam protrusion 25 has, in its side view (see FIG. 3B), a first inclined portion 25*a*, a flat portion 25*b*, and a second inclined portion 25*c*. One end of the first inclined portion 25*a* is flush with the inner surface of the front wall 22*c*. The first inclined portion 25*a* extends from the one end of the first inclined portion 25*a* away from the inner surface of the front wall 22*c* and away from the top wall 22*b*, and the other end of the first inclined portion 25*a* is connected to one end of the flat portion 25*b*. The flat portion 25*b* extends from the one end of the flat portion 25*b* to the other end of the flat portion 25*b* parallel to the inner surface of the front wall 22*c*. One end of the second inclined portion 25*c* is connected to the other end of the flat portion 25*b*. The second inclined portion 25*c* extends from the one end of the second inclined portion 25*c* towards the inner surface of the front wall 22*c* and away from the top wall 22*b*, and the other end of the second inclined portion 25*c* is flush with the inner surface of the front wall 22*c*.

Figure 4:
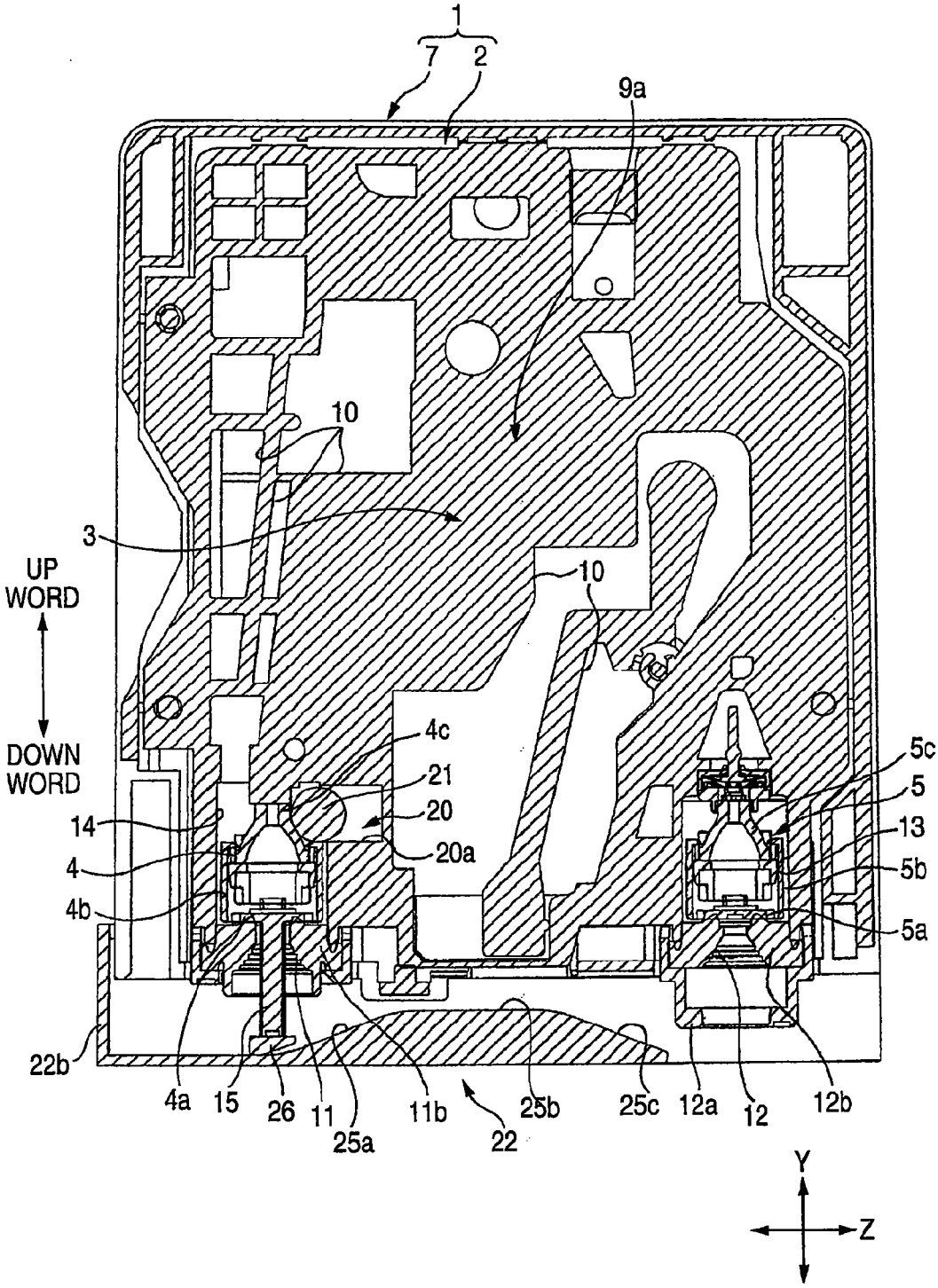
FIG. 4 is a cross-sectional view of the ink cartridge of FIGS. 2A-2C in which an atmospheric introduction opening and an ink supply opening face downward.

The operation rod 15 includes a cam follower, e.g., a sliding member 26 configured to slidably contact the cam protrusion 25. The sliding member 26 reduces friction resistance against the surface of the cam protrusion 25, and enables smooth movement of the operation rod 15 in the first direction and the fourth direction in response to movement of the covering member 22. The shape of the surface of the sliding member 26 which is brought into contact with the surface of the cam protrusion 25 may be an inclined plane as illustrated in FIG. 1A, FIG. 4 and FIG. 5, or may be a semi-spherical or a convex (not illustrated).

The ink cartridge 1 is configured to be inserted in a horizontal direction into a cartridge mounting portion (not illustrated) of a multi-function device (MFD) (not illustrated) equipped with a printer function, a copying function, a scanning function, and a facsimile function. At an end of the cartridge mounting portion, an operation member (not illustrated) and an ink extraction pipe (not illustrated) are positioned to horizontally protrude from the end of the cartridge mounting portion. When the ink cartridge 1 is mounted to the cartridge mounting portion, the operation member contacts the sliding member 26 of the operation rod 15 and pushes the operation rod 15, and then the valve body 4*a* moves to separate from the valve seat 11*b* to open the atmospheric introduction opening 11. Moreover, when the ink cartridge 1 is mounted to the cartridge mounting portion, the ink extraction pipe contacts and pushes the valve body 5*a*, and then the valve body 5*a* moves to separate from the valve seat 12*b* to open the ink supply opening 12. Ink is then supplied from the ink reservoir portion 3 to a recording head (not illustrated) of the MFD via the ink extraction pipe. The operation member is positioned above the ink extraction pipe. When the ink cartridge 1 is mounted to the cartridge mounting portion, the ink cartridge 1 is positioned in a predetermined orientation such that the atmospheric introduction opening 11 and the ink supply opening 12 face the end of the cartridge mounting portion, and the atmospheric introduction opening 11 is positioned above the ink supply opening 12. The ink cartridge 1 and the cartridge mounting portion are configured such that the atmospheric release valve 4 opens the atmospheric introduction opening 11 before the ink supply valve 5 opens the ink supply opening 12.

Because the ink cartridge 1 is mounted to the cartridge mounting portion in the predetermined orientation, air (air bubbles) in the liquid reservoir portion 3 is collected to the atmospheric introduction opening 11 side positioned above the ink supply opening 12. Therefore, air is prevented from flowing to the recording head via the ink supply opening 12.

In this embodiment, the pressure in the ink reservoir portion 3 of the ink cartridge 1 is depressurized to be less than the atmospheric pressure when the ink cartridge 1 is manufactured. By removing the covering member 22 from the outer case 7 before mounting the ink cartridge 1 to the cartridge mounting portion, the pressure in the ink reservoir portion 3 of the ink cartridge 1 is restored to be equal to or slightly less than the atmospheric pressure via the atmospheric introduction opening 11.

It is preferable that the covering member 22 is removed from the outer case 7 when the ink cartridge 1 is positioned in an orientation such that the atmospheric introduction opening 11 is positioned above the ink supply opening 12. If the atmospheric introduction opening 11 were positioned below the ink supply opening 12 when the covering member 22 is removed, air introduced via the atmospheric introduction opening 11 might reach the vicinity of the ink supply opening 12, which might cause the printing failure. As shown in FIG. 5, when a user holds the ink cartridge 1 in his hand such that the top wall 22*b* of the covering member 22 is positioned to face substantially upwards, that is, such that the atmospheric introduction opening 11 is positioned above the ink supply opening 12, the spherical body 21 moves to the bottom surface of the space 20 by its own weight, and the spherical body 21 is positioned apart from the spring 4*c* of the atmospheric release valve 4 as illustrated in FIG. 5. Therefore, the atmospheric release valve 4 can open the atmospheric introduction opening 11.

Figure 7:
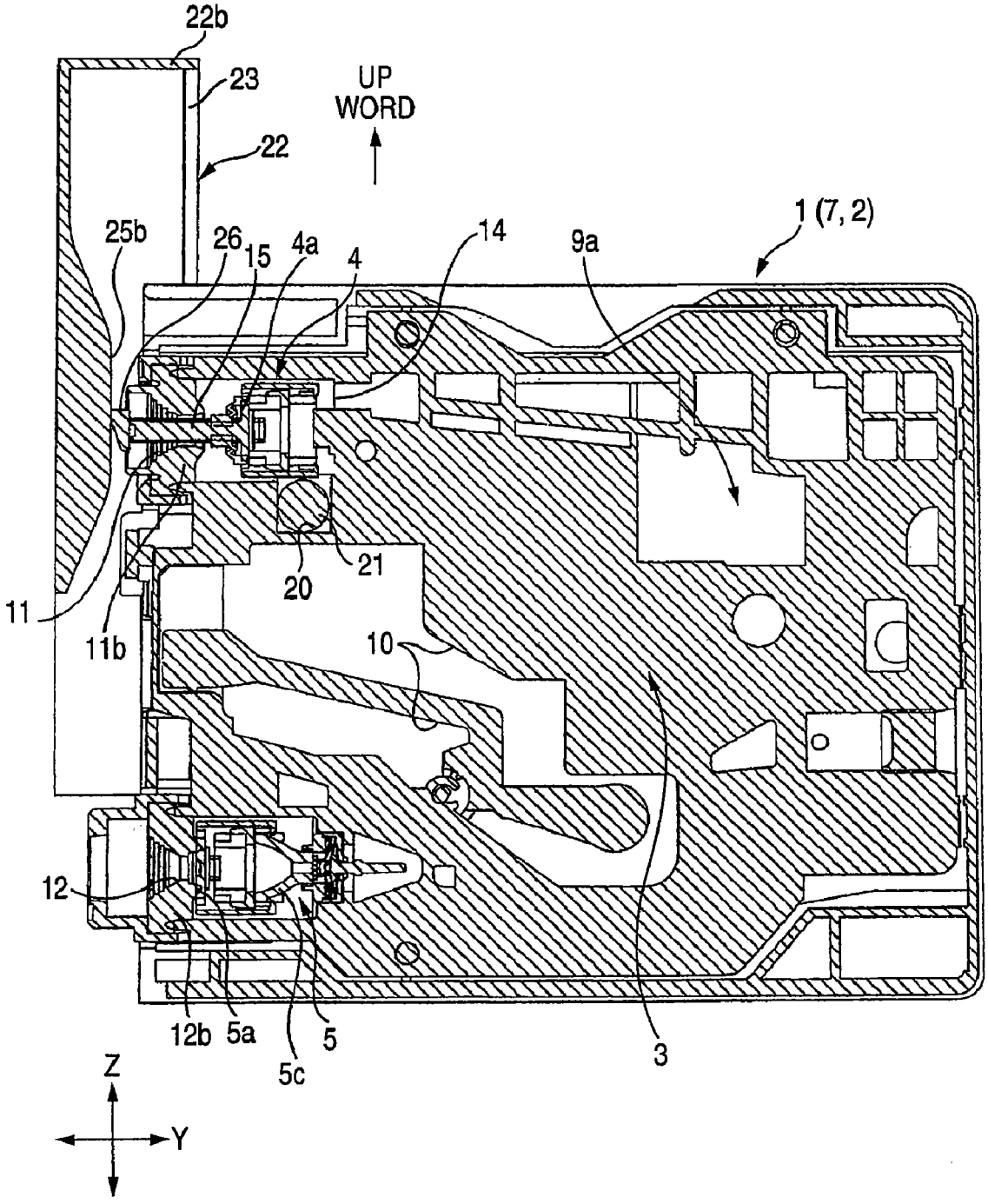
FIG. 7 is an cross-sectional view of the ink cartridge of FIGS. 6A-6B taken along the line VII-VII of FIG. 6B.

When the covering member 22 moves in the second direction, the flat portion 25*b* of the cam protrusion 25 contacts the sliding member 26 of the operation rod 15 and pushes the operation rod 15 in the fourth direction as illustrated in FIG. 7. When the operation rod 15 is pushed, the spring 4*c* resiliently deforms. (the spring 4*c* is not illustrated in FIG. 7). Therefore, the atmospheric release valve 4 opens the atmospheric introduction opening 11 such that air is introduced into the ink reservoir portion 3 and is accumulated at an upper portion of the ink reservoir portion 3, which is positioned apart from the ink supply opening 12. When the covering member 22 is completely removed from the outer case 7, or at least when the sliding member 26 moves beyond the second inclined portion 25*c*, the atmospheric release valve 4 returns to its original position by the urging force of the spring 4*c*.

Incidentally, a correct orientation of the ink cartridge 1 held by the user when the covering member 22 is removed is the orientation in which air is accumulating at a position far from and above the ink supply opening 12 in the ink reservoir portion 3. The correct orientation is realized when the atmospheric introduction opening 11 is positioned above the ink supply opening 12.

When the ink cartridge 1 is positioned in the correct orientation, the spherical body 21 rolls on the guiding surface 20*a* of the space 20, and separates from the spring 4*c*.

When the ink cartridge 1 is not in the correct orientation, that is, when the atmospheric introduction opening 11 is positioned below the ink supply opening 12, the guiding surface 20*a* is inclined downward toward the spring 4*c*. Therefore, the spherical body 21 rolls on the guiding surface 20*a* by a gravitation force acting on the spherical body 21 or a component of the gravitational force 21 in the direction along the guiding surface 20*a*, and the spherical body 21 contacts the spring 4*c*.

When the spherical body 21 contacts the spring 4*c*, even if the covering member 2 moves in the second direction, and the operation rod 15 is attempted to be pushed in the fourth direction, the spherical body 21 prevents resilient deformation of the spring 4*c*, thereby the atmospheric release valve 4 cannot move as illustrated in FIG. 4.

Referring to FIG. 8A through FIG. 8C and FIG. 9, an ink cartridge 30 according to another embodiment of the present invention is described. The ink cartridge 30 includes a case 32 having a substantially rectangular parallelepiped shape having a front face 32*c*, a rear face 32*e* opposite the front face 32*c*, a top face 32*d*, a bottom face 32*f* opposite the top face 32*d*, and a pair of side faces 32*a* opposite each other. Each of the top face 32*d* and the bottom face 32*f* is connected to the front face 32*c* and the rear face 32*e*, and each of the pair of side faces 32*a* is connected to the front face 32*c*, the rear face 32*e*, the top face 32*d*, and the bottom face 32*f*. Each of the front face 32*c*, the rear face 32*e*, the top face 32*d*, the bottom face 32*f*, and the pair of side faces 32*a* is substantially parallel to the opposing face and substantially perpendicular to the other faces. Each of an area of the pair of side faces 32*a* is greater than each of an area of the front face 32*c*, an area of the rear face 32*e*, an area of the top face 32*d*, and an area of the bottom face 32*f*. An atmospheric introduction opening 31 is formed through the top face 32*d*. An atmospheric release valve 34 is positioned in the case 32 to selectively open and close the atmospheric introduction opening 31. An ink supply opening 33 is formed through the front face 32*c*. An ink supply valve (not illustrated) is positioned in the case 32 to selectively open and close the ink supply opening 33.

The case 32 has an atmospheric introduction chamber 37 connected to the atmospheric introduction opening 31. The atmospheric release valve 34 is movably positioned in the atmospheric introduction chamber 37 and includes a valve body 34*a*, valve retaining frame (not illustrated), and spring body (not illustrated) positioned in this order. An operation rod 35 extends from the valve body 34*a* to the outside of the case 32 via the atmospheric introduction opening 31 in a fifth direction which is parallel to a Y-axis direction. The operation rod 35 includes a cam follower, e.g., a boat-shaped sliding body 36.

When the operation rod 35 is pushed in a sixth direction opposite the fifth direction the valve body 34*a* of the atmospheric release valve 34 separates from a valve seat (not illustrated), and the atmospheric release valve 34 opens the atmospheric introduction opening 31, thereby air is introduced from the outside of the case 32 into the atmospheric introduction chamber 37.

Figure 8C:
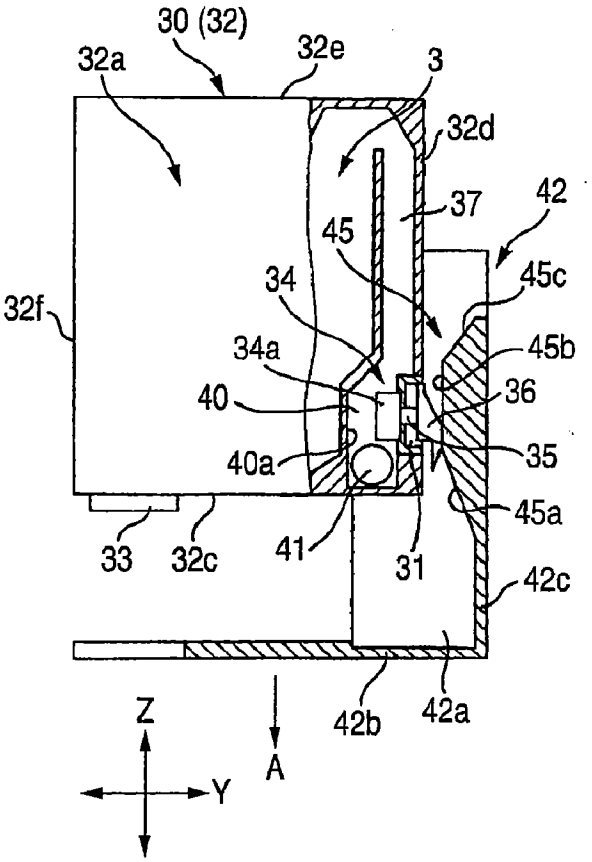
FIG. 8C is a partially-cross-sectional side view of the ink cartridge of FIG. 8A in which a covering member is removed from a case of the ink cartridge.
Figure 8B:
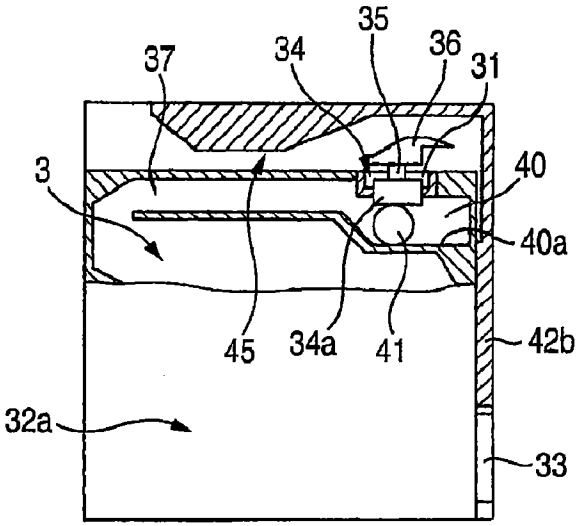
FIG. 8B is a partially-cross-sectional side view of the ink cartridge of FIG. 8A, in which the ink cartridge is positioned in an incorrect orientation.

A space 40 that communicates with the interior of the atmospheric introduction chamber 37 is formed adjacent to the atmospheric introduction chamber 37. A spherical body such as steel ball 41 is movably positioned in the space 40. The spherical body 41 is movable along the guiding surface 40*a* defining a portion of the space 40 as illustrated in FIG. 8B and FIG. 8C. The guiding surface 40*a* of the space 40 extends is the Z-axis direction. In other words, the guiding surface 40*a* extends in a direction perpendicular to the fifth direction in which the operation rod 35 extends from the valve body 34*a* to the outside of the case 32.

The spherical body 41 moves to and moves away from the atmospheric release valve 34 by the gravitational force acting on the spherical body 41 or by a component of the gravitational force acting on the spherical body 41 along the guiding surface 40*a* of the space 40.

Figure 8A:
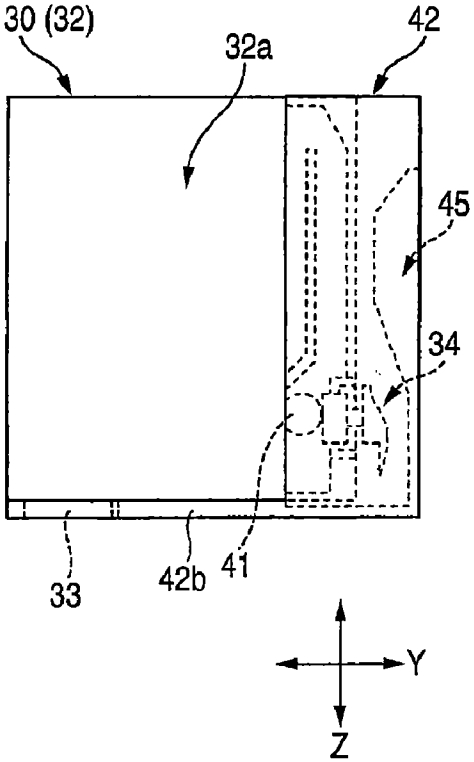
FIG. 8A is a side view of an ink cartridge according to another embodiment of the present invention.

Therefore, when the ink cartridge 30 is positioned in an orientation such that the guiding surface 40*a* extends in a direction parallel to the direction of the gravitational force that is, such that the atmospheric introduction opening 31 is positioned above the ink supply opening 33, as illustrated in FIG. 8A and FIG. 8C, the spherical body 41 moves downward and separates from the valve body 34*a* of the atmospheric release valve 34, and the atmospheric release valve 34 is allowed to move.

On the contrary, as illustrated in FIG. 8B, when the ink cartridge 30 is positioned in an orientation such that the guiding surface 40*a* of the space 40 extends in the horizontal direction which is perpendicular to the direction of the gravitational force, or in any orientations such that the spherical body 41 moves to be positioned below the valve body 34*a*, the atmospheric release valve 34 is prevented from moving.

The ink cartridge 30 includes a covering member 42 removably attached to the case 32. When the operation rod 35 is pushed against an urging force of a spring (not illustrated) in response to movement of the covering member 42, the valve body 34*a* separates from the valve seat and the atmospheric introduction opening 31 is opened. In this embodiment, as illustrated in FIG. 8A through FIG. 8C, the covering member 42 includes a pair of left and right side walls 42*a*, a front wall 42*b* connected to front ends of the pair of left and right end walls 42*a*, and a top wall 42*c* connected to top ends of the pair of left and right side walls 42*a* and front wall 42*b*. The pair of left and right side walls 42*a* is configured to cover at least a portion of the pair of side faces 32*a* of the case 32 respectively, the front wall 42*b* is configured to cover at least a portion of the front face 32*c* of the case 32, and the top wall 42*c* is configured to cover at least a portion of the top face 32*d* of the case 32. The covering member 42 is configured to be removably attached to the case 32 such that the covering member 42 covers the atmospheric introduction opening 31. The covering member 42 is configured to be removed from the case 32 in a seventh direction and to be attached to the case 32 in an eighth direction opposite the seventh direction. The seventh direction and the eighth direction are parallel to the Z-axis direction. In other words, each of the seventh direction and the eighth direction is perpendicular to the fifth direction in which the operation rod 35 extends from the valve body 34*a* to the outside of the case 32. In further other words, the covering member 22 is configured to be attached to and removed from the outer case 7 in directions substantially parallel to a direction in which the top face 32*d* of the case 32 extends.

A cam protrusion 45 extending in the Z-direction is positioned at an inner surface of the top wall 42*c* facing the top face 32*d* of the case 32. When the covering member 42 is removed from the case 32 in the seventh direction which is parallel to the top face 32*d*, the cam protrusion 45 applies a force to the operation rod 35, e.g., contacts the sliding member 36 of the operation rod 35 and pushes the operation rod 35, to move the operation rod 35 in the sixth direction. The valve body 34*a* then moves to separate from the valve seat to open the atmospheric introduction opening 31.

In this embodiment, a guide protrusion ridge extending in a direction parallel to the seventh and eighth directions is formed on an inner surface of each of a pair of left and right side walls 42*a*. A guide groove extending in the direction parallel to the seventh and eighth directions is formed in each of the pair of side faces 32*a* of the case 32. The guide protrusion ridges are configured to slidably engage the guide grooves such that the covering member 42 covers the atmospheric introduction opening 31. The front wall 42*b* functions as a stopper, that is, the front wall 42*b* is configured to restrict the movement of the covering member 42 relative to the case 32 in the eighth direction, e.g., configured to contact the front face 32*c* of the case 32 and to prevent further movement of the covering member 42 relative to the case 32 in the eighth direction.

The covering member 42 can be removed from the case 32 only in the seventh direction because the front wall 42*b* is configured to contact the front face 32*c* of the case 32 and to prevent further movement of the covering member 42 relative to the case 32 in the eighth direction. The atmospheric introduction opening 31 is positioned on a downstream side in the seventh direction (the direction of the arrow A in FIG. 8C). Therefore, most part of the top wall 42*c* of the covering member 42 can be used for covering the atmospheric introduction opening 31 during the movement of the covering member 42 in the seventh direction. In the other words, the covering member 42 is configured to cover the atmospheric introduction opening 41 until the very end of removing the covering member 42 from the case 32.

The entire surface of the ink supply opening 33 may be covered and protected by the front wall 42*b* when the covering member 42 is attached to case 32. Alternatively, the ink supply opening 33 may not be covered by the front wall 42*b*.

In this embodiment, as shown in FIG. 8A and FIG. 8C, the cam protrusion 45 extends relatively long in the seventh direction. Moreover, a profile of the cam protrusion 45 has, in its side view (see FIG. 8C), a first inclined portion 45*a*, a flat portion 45*b*, and a second inclined portion 45*c*. One end of the first inclined portion 45*a* is flush with the inner surface of the top wall 42*c*. The first inclined portion 45*a* extends from the one end of the first inclined portion 45*a* away from the inner surface of the top wall 42*c* and away from the front wall 42*b*, and the other end of the first inclined portion 45*a* is connected to one end of the flat portion 45*b*. The flat portion 45*b* extends from the one end of the flat portion 45*b* to the other end of the flat portion 45*b* parallel to the inner surface of the top wall 42*c*. One end of the second inclined portion 45*c* is connected to the other end of the flat portion 45*b*. The second inclined portion 45*c* extends from the one end of the second inclined portion 45*c* towards the inner surface of the top wall 42*c* and away from the front wall 42*b*, and the other end of the second inclined portion 45*c* is flush with the inner surface of the top wall 42*c*.

In this embodiment, the pressure in an ink reservoir portion of the ink cartridge 30 is depressurized to be less than the atmospheric pressure when the ink cartridge 30 is manufactured. By removing the covering member 42 from the case 32 before mounting the ink cartridge 30 to a cartridge mounting portion, the pressure in the ink reservoir portion of the ink cartridge 30 is restored to be equal to or slightly less than the atmospheric pressure via the atmospheric introduction opening 31.

It is preferable that the covering member 42 is removed from the case 32 when the ink cartridge 1 is positioned in an orientation such that the ink supply opening 33 faces downward and the spherical portion 41 moves to separate from the atmospheric release valve 34 to enable the atmospheric release valve 34 to open the atmospheric introduction opening 31. As shown in FIG. 8C, when a user holds an ink cartridge 30 in his hand such that the front wall 42*b* of the covering member 42 is positioned to face substantially downward, the spherical body 41 moves to the bottom surface of the space 40 by its own weight, and the spherical body 41 is positioned apart from the atmospheric release valve 34. Therefore, the atmospheric release valve 34 can open the atmospheric introduction opening 31.

When the covering member 42 moves in the seventh direction (see FIG. 8C), the flat protrusion portion 45*b* of the cam protrusion 45 contacts the sliding member 36 of the operation rod 35 and pushes the operation rod 35 in the sixth direction. When the operation rod 35 is pushed, the atmospheric release valve 34 opens the atmospheric introduction opening 31 such that air is introduced into the ink reservoir portion and is accumulated at an upper portion of the ink reservoir portion, which is positioned apart from the ink supply opening 33. When the covering member 42 is completely removed from the case 32 or at least when the sliding member 36 moves beyond the second inclined portion 45*c*, the atmospheric release valve 34 returns to its original position by the urging force of the spring.

When the ink cartridge 30 is in an orientation such that the spherical portion 41 moves to the atmospheric release valve 34, the spherical body 41 contacts the valve body 34*a*. Therefore, even if the operation rod 35 is attempted to be pushed when the covering member 42 moves in the seventh direction, the spherical body 41 prevents the valve body 34*a* from moving, thereby the atmospheric release valve 34 cannot open the atmospheric introduction opening 31.

Figure 9:
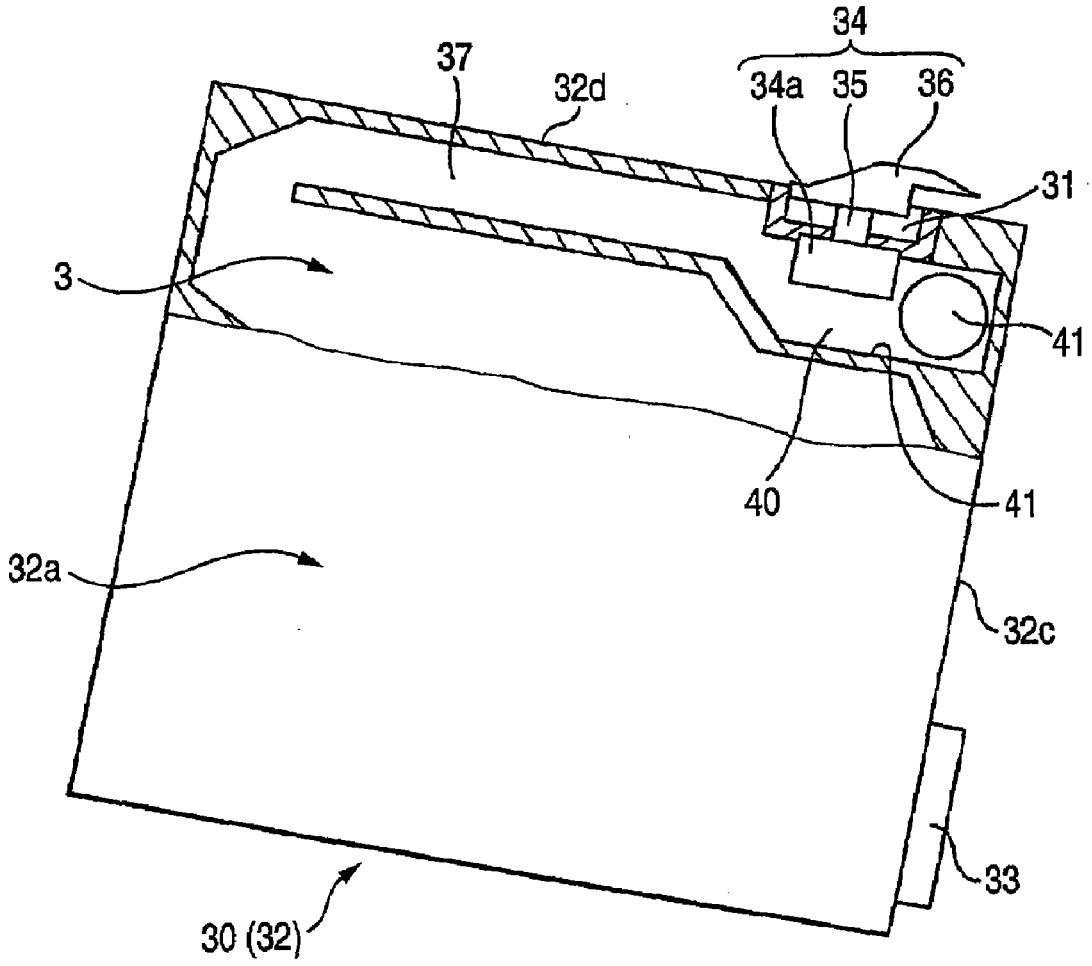
FIG. 9 is a partially-cross-sectional side view of the ink cartridge of FIGS. 8A-8C, in which the covering has been removed.

After the ink reservoir portion is brought into communication with the atmosphere, when mounting the ink cartridge 30 to the cartridge mounting portion, the ink cartridge 30 is positioned in an orientation such that the top wall 32*d* of the case 32 faces upward, but is tilted such that one end of the top wall 32*d* adjacent to the atmospheric introduction opening 31 is positioned slightly below the other end of the top wall 32*d*, which is positioned opposite from the one end of the top wall 32*d*, as illustrated in FIG. 9. Thereby, the spherical body 41 is positioned apart from the valve body 34*a*, and the atmospheric release valve 34 can move.

An elliptical body may be used instead of the spherical body 21 (41). Moreover, any bodies can be used if the body smoothly moves or rolls along the guiding surface by the gravitational force acting on the body or by a component of the gravitational force along the guiding surface. Also, the position where the body prevents the atmospheric release valve from moving may be not only be the position where the body contacts the spring but also somewhere else where the body contacts a portion of the atmospheric release valve. Therefore, the space 20 (40) may be formed at a position corresponding to the position of the body.

With the configuration of at least one of the above-described embodiments, when the covering member is removed in a predetermined direction, the atmospheric release valve can readily open the atmospheric introduction opening.

In addition, even if the operation rod protrudes from the case, ink may not leak from the atmospheric introduction opening when the ink cartridge is transported or is kept in storage, because the operation rod is covered by the covering member and therefore the operation rod may not be erroneously operated.

Moreover, after the covering member is removed from the case, the atmospheric release valve closes the atmospheric introduction opening again. Therefore, ink may not leak from the atmospheric introduction opening until the ink cartridge is mounted to the cartridge mounting portion.

The covering member can be removed from the case in a single direction. Therefore, a user is prevented from removing the covering member from the case in a wrong direction. Moreover, the structure for preventing the removal of the covering member in the wrong direction is simple, which contributes to a lowering in costs.

Even if a user holds the ink cartridge in an incorrect orientation and attempts to remove the covering member, the spherical body prevents the atmospheric release valve from moving. Therefore, the atmospheric introduction opening is prevented from being opened erroneously. Moreover, the structure for preventing the erroneous opening of the atmospheric introduction opening is simple, which contributes to a lowering in costs.

The covering member is configured to be removed from the case in the above-described embodiments. Nevertheless, the covering member may not be configured to removed from the case when the ink cartridge is mounted to the image recording apparatus, as long as the atmospheric release valve opens the atmospheric introduction opening in accordance with the movement of the covering member and then close the atmospheric introduction opening in accordance with further movement of the covering member prior to the mounting to the image recording apparatus.

The ink cartridge is exemplified as a liquid container in the above-described embodiments. Nevertheless, the liquid container may be suitable for supplying a liquid to a liquid ejecting apparatus. For example, the liquid ejecting apparatus may include a liquid ejecting head (a print head) of an ink jet type recording apparatus, a coloring agent ejecting head of a color filter manufacturing apparatus for manufacturing a color filter of a liquid crystal display, an electrode material (conductive paste) ejecting head for forming an electrode of an organic EL display or an FED (a surface emitting display), and furthermore, a bioorganism ejecting head of a biochip manufacturing apparatus for manufacturing a biochip and a specimen ejecting head to be a precision pipette.

What is claimed is:

1. A liquid container comprising:

a case having a liquid reservoir portion defined therein, and having a particular face at which an atmospheric introduction opening is positioned;

an atmospheric release valve positioned in the case and configured to selectively open the atmospheric introduction opening to allow the liquid reservoir portion to communicate with the atmosphere via the atmospheric introduction opening and close the atmospheric introduction opening to prevent the liquid reservoir portion from communicating with the atmosphere via the atmospheric introduction opening, wherein the atmospheric release valve comprises an operation portion extending from an inside of the case to an outside of the case via the atmospheric introduction opening in a first direction;

a covering member attached to the case to cover the atmospheric introduction opening and configured to move relative to the case in a second direction and a third direction opposite the second direction, wherein each of the second direction and the third direction is substantially perpendicular to the first direction, and the covering member comprises a cam protrusion, wherein, when the covering member moves in the second direction, the cam protrusion applies a force to the operation portion to move the operation portion in a fourth direction opposite the first direction such that the atmospheric release valve opens the atmospheric introduction opening; and a preventing unit positioned in the casing and configured to selectively allow the atmospheric release valve to open the atmospheric introduction opening and prevent the atmospheric release valve from opening the atmospheric introduction opening in accordance with an orientation in which the case is positioned.

2. The liquid container according to claim 1, wherein the particular face extends in a direction parallel to the second direction and the third direction.

3. The liquid container according to claim 1, wherein the cover member is configured to be removed from the case when the cover member moves in the second direction.

4. The liquid container according to claim 3, wherein the case has an liquid supply opening positioned at the particular face;

wherein the atmospheric introduction opening is positioned apart from the liquid supply opening such that the atmospheric introduction opening is positioned on a downstream side and the liquid supply opening is positioned on an upstream side in the second direction; and wherein the covering member further comprises a stopper to restrict a movement of the covering member relative to the case in the third direction.

5. The liquid container according to claim 4, wherein the case has a further face connected to and substantially perpendicular to the particular face, and the stopper prevents the covering member from moving relative to the case in the third direction when the stopper contacts the further face.

6. The liquid container according to claim 3, wherein the case has a liquid supply opening positioned at a further face connected to and substantially perpendicular to the particular face; and wherein the covering member further comprises a stopper to restrict a movement of the covering member relative to the case in the third direction.

7. The liquid container according to claim 6, the stopper prevents the covering member from moving relative to the case in the third direction when the stopper contacts the further face.

8. The liquid container according to claim 1, wherein the preventing unit comprises a movable member configured to move to and move away from the atmospheric release valve in a fifth direction by a gravitational force acting on the movable member or by a component of the gravitational force along the fifth direction.

9. The liquid container according to claim 8, wherein the movable member is a spherical body or an elliptical body.

10. The liquid container according to claim 1, wherein the operation portion comprises a cam follower configured to slidably contact the cam protrusion.

11. The liquid container according to claim 1, further comprising a liquid supply opening and a liquid supply cover member configured to cover the liquid supply opening.

12. The liquid container according to claim 11, wherein the liquid supply cover member comprises a liquid supply valve configured to selectively open and close the liquid supply opening.

13. The liquid container according to claim 1, wherein the liquid reservoir portion stores ink.

14. An liquid container comprising:

a case having a liquid reservoir portion defined therein;

an atmospheric release valve configured to move between an open position and a close position, the liquid reservoir portion being allowed to communicate with the atmosphere when the atmospheric release valve is positioned at the open position, and the liquid reservoir portion being prevented from communicating with the atmosphere when the atmospheric release valve is positioned at the close position, wherein the atmospheric release valve comprises an operation portion configured to move between an operation position and an non-operation position, the atmospheric release valve is positioned at the open position when the operation portion is positioned at the operation position and the atmospheric release valve is positioned at the close position when the operation portion is positioned at the non-operation position;

a covering member movable from a first position to a third position via a second position and comprising a cam protrusion, wherein, when the covering member is positioned at the first position, the covering member covers the operation portion and allows the operation portion to be positioned at the non-operation position, wherein, when the covering member is positioned at the second position, the cam protrusion contacts the operation portion to position the operation portion at the operation position, and wherein, when the covering member is positioned at the third position, the covering member allows the operation portion to be positioned at the non-operation position; and a preventing unit positioned in the casing and configured to selectively allow the atmospheric release valve to open the atmospheric introduction opening and prevent the atmospheric release valve from opening the atmospheric introduction opening in accordance with an orientation in which the case is positioned.

15. The liquid container according to claim 14, wherein, when the covering member is positioned at the third position, the operation portion is uncovered.

16. The liquid container according to claim 15, wherein the covering member is removable from the case, and wherein the covering member is removed from the case when the cover member is positioned at the third position.

* * * * *